US005331902A

United States Patent [19]

Hawthorne et al.

[11] Patent Number: 5,331,902

[45] Date of Patent: Jul. 26, 1994

[54] TRUCK BOLTSER WITH LATERALLY WIDER FRICTION SHOW POCKET AND MECHANISM FOR LATERAL TRAVEL OF THE FRICTION SHOE

[75] Inventors: V. Terrey Hawthorne, Lisle; Anthony R. Hiatt, St. Charles, both of Ill.; Franklin S. McKeown, St. Louis, Mo.

[73] Assignee: Amsted Industries Incorporated, Chicago, Ill.

[21] Appl. No.: 88,070

[22] Filed: Jul. 6, 1993

[51] Int. Cl.[5] ..... B61F 5/50

[52] U.S. Cl. ..... 105/198.2; 105/185

[58] Field of Search ..... 105/190.2, 191, 198.2, 105/198.4, 185; 267/196, 202, 205, 209, 214

[56] References Cited

U.S. PATENT DOCUMENTS

| | | | |
|---|---|---|---|
| 3,339,498 | 9/1967 | Weber | 105/198.2 |
| 4,167,907 | 9/1979 | Mulcahy et al. | 105/198.4 |
| 4,915,031 | 4/1990 | Wiebe | 105/198.2 |
| 4,953,471 | 9/1990 | Wronkiewicz et al. | 267/205 X |
| 5,095,823 | 3/1992 | McKeown, Jr. | 105/198.2 |

*Primary Examiner*—Robert J. Oberleitner
*Assistant Examiner*—S. Joseph Morano
*Attorney, Agent, or Firm*—Edward J. Brosius; F. S. Gregorczyk; Thomas J. Schab

[57] ABSTRACT

Prior art railcar bolsters and friction shoe assemblies were constructed such that the friction shoe was tightly restrained within the friction shoe pocket. The present invention utilizes a friction shoe sled for promoting lateral sliding of the friction shoe assembly within a laterally wider bolster friction shoe pocket. The sliding mechanism incorporates the use of an pad is countersunk into the floor of the friction shoe pocket and the base of the sled. The sled is fitted underneath the friction shoe to support the friction shoe biasing spring as well as the friction shoe. The top of the sled has a post attached to it, for insertion into the bottom of the friction shoe biasing spring. The bottom of the sled preferably has the elastomeric pad attached to it, although it can be smoothly machined, so that the bottom surface of the sled slides along the elastomeric pad anchored to the friction shoe pocket floor. The spring sled and the elastomeric pad anchored to the friction shoe pocket floor create a very low coefficient of friction environment for ultimately allowing the friction shoe, the biasing spring, and the sled, to laterally slide or "float" in unison within the wider friction shoe pocket. By providing relative lateral movement between the friction shoe and the bolster friction shoe pocket, any laterally directed forces which act upon the railcar and cause lateral acceleration on the car, can be isolated in order to decrease lateral car instability.

19 Claims, 3 Drawing Sheets

TRUCK BOLTSER WITH LATERALLY WIDER FRICTION SHOW POCKET AND MECHANISM FOR LATERAL TRAVEL OF THE FRICTION SHOE

FIELD OF INVENTION

The present invention relates to an improved railcar truck bolster and more particularly, to a bolster having a laterally wider friction shoe pocket and means for promoting lateral sliding movement of a winged-type friction shoe within the wider pocket in order to decouple the lateral motion or lateral acceleration between the railcar truck sideframe and the bolster.

BACKGROUND OF THE INVENTION

Railway trucks are well known in the railway industry and it has been common practice to support the opposite ends of a freight car body on a pair of spaced car trucks. Each truck comprises two wheel sets mounted on axles, with both axles being joined by and supported by a pair of spaced side frame casting members which extend generally longitudinally along the opposite sides of the car body. The side frames are located outboard of the wheels and are mounted on the axles by roller bearing assemblies with appropriate adapters. An elongated bolster casting is centrally mounted parallel to the axles and received within a window in each of the side frames castings. The bolster casting is supported within each respective side frame casting by a suspension system including respective spring sets on each bolster end for permitting limited movement of the bolster relative to the side frames. Depending upon the load capacity of the railcar, the spring set can comprise a varying number of outer coils, inner coils, or shock absorbing devices. In the various spring set configurations, the springs extend between a spring seat on each side frame and a respective undersurface of the bolster, holding the bolster in a spaced relationship relative to the spring seat. The weight of the freight car body is generally supported by a centrally disposed bolster center plate, but when the car body laterally tips, some weight is then transferred to either of a pair of bolster-mounted side bearing assemblies. Each side bearing assembly is located generally on the distal bolster end and inboard of its respective side frame. The bolster center plate is centrally disposed between each of the bearing assemblies. Typically, there are four major types of car instability that are directly related to this type of freight car body support and they will now be described.

The first type of car instability is referred to as truck hunting, which is caused by lateral forces imputed to the car body. Hunting usually occurs at high speeds wherein the truck assembly no longer remains parallel to the rails, causing it to weave down the track, usually with the wheel flanges striking the rails. In addition, truck lozenging or warping accompanies such hunting wherein the bolster turns out of square with respect to the side frames.

The second type of instability is referred to as rock and roll and this type of car instability usually occurs at low speeds and is caused by the joints in the tracks. Jointed track is frequently non-planar due to excessive settlement which results from worn joints and non-uniform ballast or foundation under the railway ties. Because track joints are staggered with respect to the rail pairs, a railcar will first experience a joint on one rail before experiencing the next successive joint on the opposite rail; the alternating pattern continues as the car travels down the track. Each time the unplanar rail ends forming the joint are encountered, the wheel movements in the truck assemblies will impart energy to the truck suspension system, causing the car body to rock or sway excessively in a lateral direction with respect to the tracks.

The third type of instability is caused by bouncing or pitching of the car body when the railcar experiences a dip or rise in the track. This instability occurs in a direction which coincides with the length of the railcar.

The final type of car instability, which the present invention addresses, is similar to hunting, in that it is another form of lateral instability. It is typically excited by track irregularities, such as worn track joints, wherein lateral acceleration is being transmitted into the car body. This type of car instability also has a linear relationship with respect to car speed, meaning that as the speed of the train increases, the car will become increasingly unstable, especially at high speeds (60 mph and above). Like hunting, any lateral instability imputed to the car body from this form of instability will correspondingly decrease the speed at which the car can be safely operated. Therefore, it is a common desire of railroad operators to eliminate as many types of car instability as possible. When specifically trying to reduce or eliminate the fourth type of instability just described, it has been discovered that if the car body can be isolated or decoupled from the truck assembly (including the bolster), the lateral acceleration or lateral motion on the car body can be effectively controlled.

There has been considerable prior art describing the physical decoupling of the lateral forces between the track and the car body. For example, in the passenger car field, swing hangers have been used for years, where the approach is to suspend the car with links that permit the car body to swivel with respect to the wheelsets. However, the biggest disadvantage of swing hangers is that they are very expensive and therefore impractical for use in the freight car field.

Other methods for isolating the lateral forces involved the incorporation of various means for decoupling the truck from the car body at the axle or journal. In general, this art fell into three categories: 1) Plain bearings, which were comprised of brass shells lined with a babbitt material, thereby providing considerable lateral travel with well lubricated surfaces; 2) Cylindrical roller bearings, which allowed the axle to slide relative to the truck, thus decoupling the lateral motions from the car body; and 3) Sliding bearing adapters, which placed an elastomeric pad between the bearing adapter and the sideframe, allowing lateral motion to be isolated before being transferred into the bolster. However, there has not been much developed art which describes a friction shoe sliding with respect to the bolster as the means for decoupling the lateral motions of the truck from the car body.

The most common means employed today for dissipating the energies imparted to the truck assembly suspension system use friction shoe assemblies which dampen the relative vertical motion between the bolster and the side frames. Typically, each truck bolster end includes a pair of opposed friction shoe pockets, each of which houses either a single or double friction shoe. Each pocket includes a pair of spaced, sloped surfaces which a engage a corresponding pair of sloped surfaces on the friction shoe, thereby transferring a load imposed by a steel coil biasing spring, placed below the friction shoe, from a vertical to a horizontal orientation. Each friction shoe also includes a flat, vertical face which is in sliding frictional engagement with a replaceable hardened steel frictional wear plate attached to each of the bolster side frame columns, thereby frictionally dissipating any imparted energy.

In this respect, improvements made to friction shoe devices have mainly concentrated on improving the characteristics of the shoe when experiencing vertically directed forces. Since the magnitude of the vertical forces acting upon the bolster are far greater than the magnitude of even the largest lateral forces which would ever act upon the railcar, the spring coil groups and the friction shoe springs of previous suspension systems were designed for addressing the vertical forces. Furthermore, since those magnitudes were so much larger, the frictional interface between any given surface on the friction shoe and the friction shoe pocket walls was so great that the friction shoe could not laterally move within the friction shoe pocket and decouple the lateral forces directed to the railcar. Since lateral movement was naturally stifled, friction shoe pockets were designed with little or no tolerance between the shoe and the pocket.

However, U.S. Pat. No. 4,167,907, developed a three piece friction shoe which was said to allow more lateral decoupling than previous art friction shoes. This shoe was limited to variable control spring loading applications, where the shoe spring deflection is directly related to the amount of vertical bolster deflection. In that design, the lateral decoupling movement which was said to exist, was truly illusory because lateral movement in a variable control spring design will only be possible when the lateral forces are greater than the vertical forces; arguably this situation might have merit but only when the cars are traveling empty.

On the otherhand, in a constant control spring system, where the shoe spring is interposed between the shoe and the base of the friction shoe pocket, downward bolster deflections are not directly experienced by the friction shoe spring. This means that with the constant control system, overcoming lateral decoupling forces becomes a matter of overcoming the static friction forces between the friction shoe and the friction shoe pocket surfaces. It should be understood that in a constant control application, the static friction forces are very small when compared to the vertical loading forces which have to be overcome in a variable control application before lateral movement is imparted. However, it should also be understood that it is particularly important to overcome these static friction forces before they approach magnitudes which could exceed the bending stiffness of the control spring, otherwise, the spring will buckle sideways, causing the shoe to become jammed within the shoe pocket.

SUMMARY OF THE INVENTION

Accordingly, it is an object of the present invention to provide a railcar truck assembly in which the lateral acceleration imparted to the truck assembly can be significantly isolated from the car body.

It is another object of the present invention to isolate the truck assembly from the car body at the friction shoe assembly by providing a truck bolster with a laterally wider friction shoe pocket which will allow substantial lateral travel of the friction shoe.

It is still another object of the present invention to provide a means for reducing the static friction forces between the surfaces of the friction shoe pocket and the friction shoe spring, thereby reducing the magnitude of the force necessary to initiate lateral movement of the friction shoe within the friction shoe pocket.

By the present invention, a truck bolster is provided with a friction shoe pocket which is laterally wider than prior art friction shoe pockets and wherein the constant control biasing spring contained within the friction shoe body, operably cooperates with a low coefficient of friction means so that the static friction forces between the friction shoe and the friction shoe pocket surfaces are overcome, thereby allowing lateral travel of the friction shoe assembly within the friction shoe pocket.

DESCRIPTION OF THE PREFERRED EMBODIMENT

Figure 1:
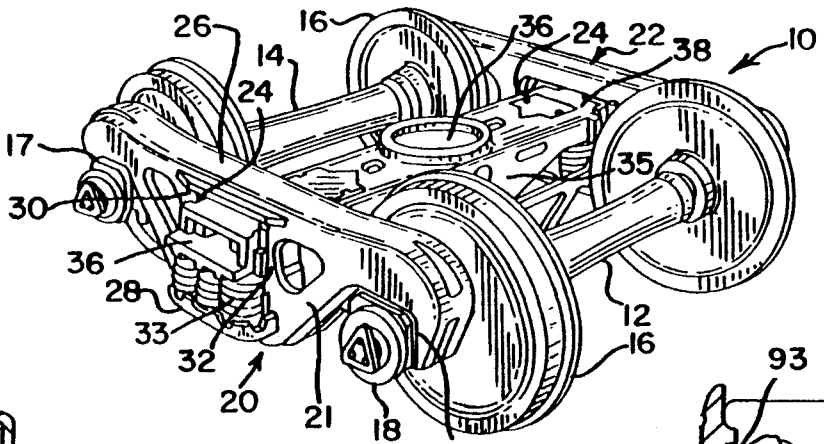
FIG. 1 is a perspective view of a railway truck.
Figure 2:
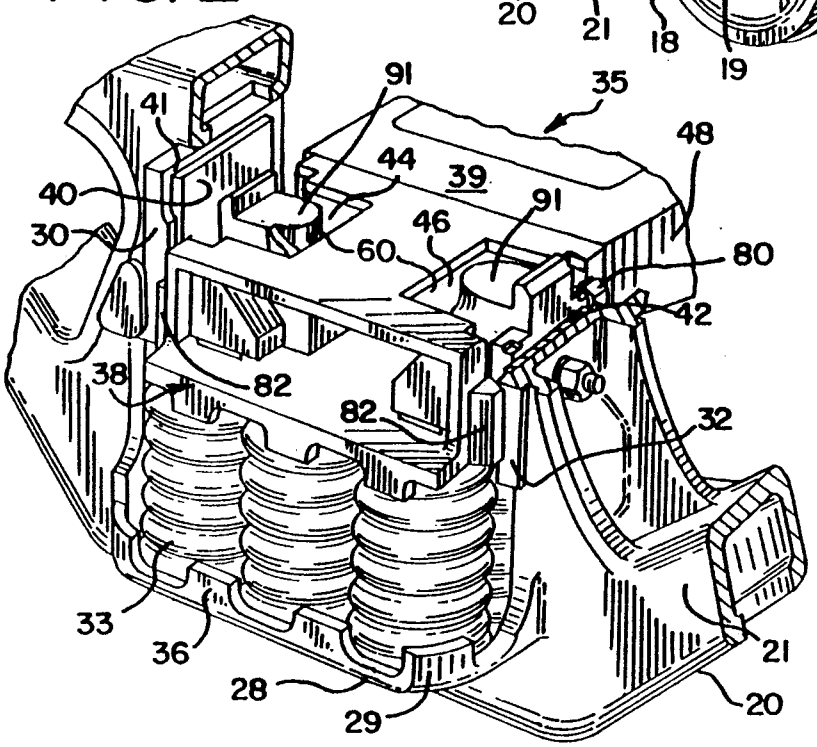
FIG. 2 is a detailed, partially cut away view of the interface between the end portion of the bolster and the side frame column bolster opening.

Referring now to FIGS. 1 and 2 of the drawings, a typical three-piece railway truck is shown generally at 10. The truck comprises a pair of axles 12, 14 each of which supports a pair of railway wheels 16. The ends of the axles 12, 14 include roller bearing assemblies 18 which are mounted in pedestal jaw openings 17, 19 in side frames 20 and 22. It is to be noted that all features of side frame 20 are likewise present in side frame 22, but not visible in FIG. 1. Side frame 20 consists of tension member 21 extending downwardly from pedestal jaw openings 17 and 19, and upper compression member 26 joined to the lower tension member 21 through side frame columns 30 and 32. Side frame columns 30, 32 are generally vertical and form bolster opening 24 therebetween. A similar opening exists between the same side frame column members found on side frame 22. A bottom spring set support shelf 28 extends outwardly from the lower portion of tension member 21 to receive the bottom end of spring set coils 33. Bolster 35 laterally extends parallel to axles 12, 14 and is comprised of a central section and a pair of distal bolster ends 38, which extends through each of the side frame bolster openings 24 on each respective sideframe 20,22. Center plate 36, which is shown attached to the center of bolster 35, receives the car body center plate (not shown) for generally supporting the weight of the railcar.

Figure 3:
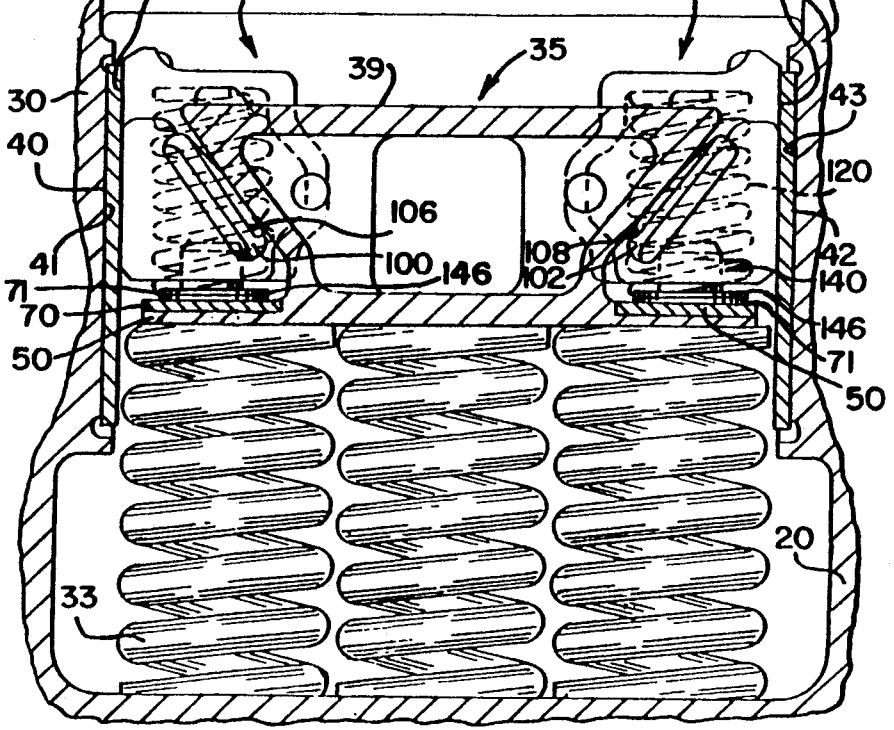
FIG. 3 is a partial, detailed cut away end view of the bolster end and the preferred embodiment of the present invention showing the means for promoting sliding between the friction shoe and the floor of the friction shoe pocket.

Referring to now to FIGS. 2 and 3, the general relationship between a bolster distal end 38, a friction shoe assembly 90, and the sideframe 20 of the present invention will now be explained. It should be understood that following description will apply to each friction shoe assembly and each friction shoe pocket since all are identical. From FIG. 2, it is seen that once the load of the car body is transferred into center plate 36 on bolster 35, the same load is transferred to each of the bolster distal ends 38. Bottom shelf 28 of side frame 20 contains upraised tabs 29 for retaining individual coil springs 33 in place. The group of springs 33 then absorb the same forces which were received at the bolster distal ends and transfers them into sideframe 20, where they are eventually distributed into the front and rear axle and wheel sets.

It is also seen that bolster distal end 38 includes a pair of opposed friction shoe pockets 44,46 at each of the lateral ends 38 of bolster 35 for housing a friction shoe assembly 90 which is used to dampen vertically directed forces applied to bolster 35 and absorbed by springs 33. The friction shoe assembly 90 consists of friction shoe 91 and biasing spring 120, which is inserted inside a hollow portion of the shoe. The article referred to in FIG. 3 as reference character 140 is part of the present invention and will be explained shortly. The friction shoe pockets shown here 44,46, differ from prior art pockets because they are wider(laterally), as will become clearer later in the description. As seen from FIGS. 2 and 3, friction shoe 91 has a vertical front wear face 93 which frictionally engages a generally planar hardened steel wear plate 40,42, respectively attached to each of the wear surfaces 41,43 on each of the side frame columns 30,32. As the bolster is vertically deflected, friction shoe surface 93 on each friction shoe 91 dampens bolster 35 by frictionally dissipating the energy stored in springs 33 by rubbing against wear plates 40,42. Each of the wear plates is replaceable so that there is no permanent structural wear or damage caused to either side frame column 30,32. Vertical gibs 80,82 are typically located on each peripheral end of pocket 46 on bolster side wall 48, so that bolster 35 is maintained in a tightly-held position with respect to sideframe 20. Gibs 80,82 are spaced such that there is little tolerance between the sideframe and either gib because it is not the desired intention to allow large, transverse movements of the bolster between each of the sideframes. Likewise, prior art friction shoe pockets were constructed with little or no tolerance between the walls of the pocket and the friction shoe since the gibs would not allow the lateral movement.

Figure 5:
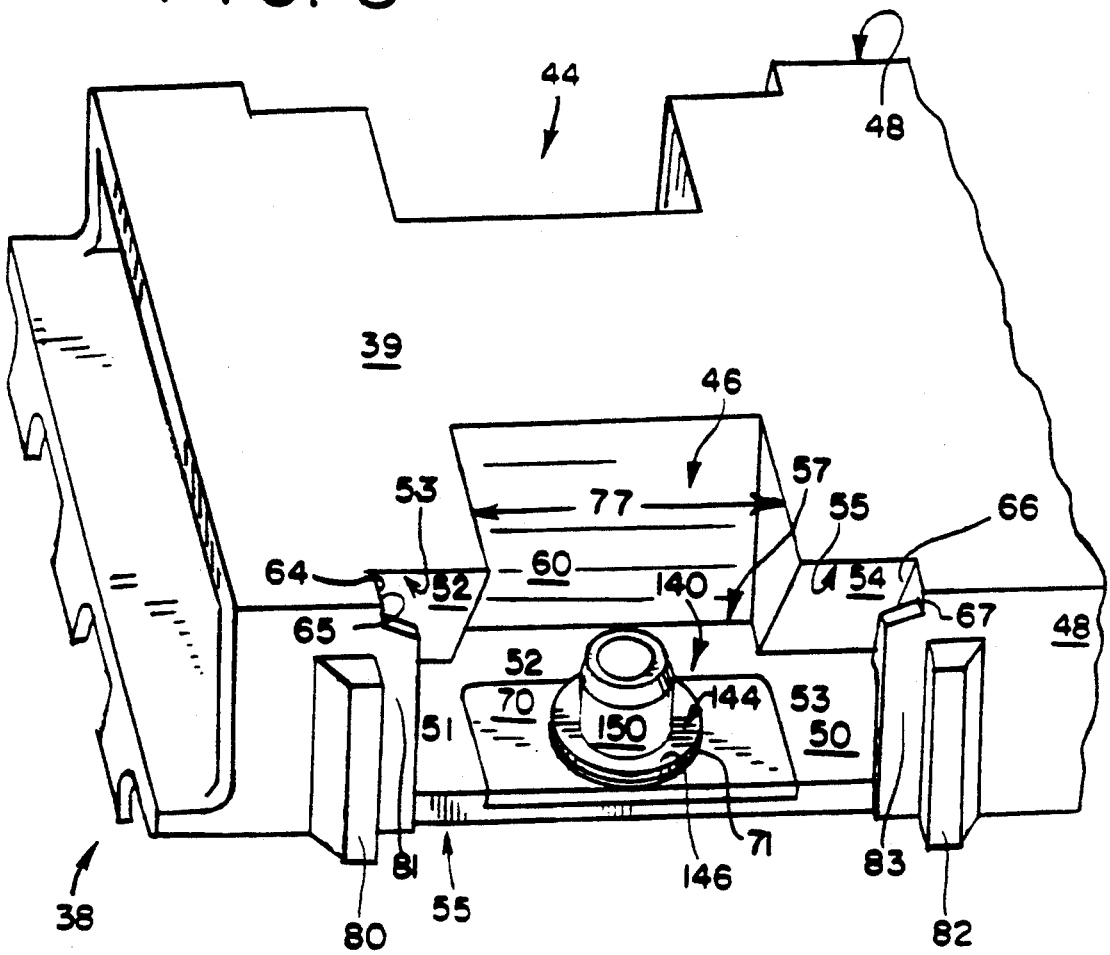
FIG. 5 is a perspective view of a bolster end showing a laterally wider friction shoe pocket with the remainder of the means for initiating lateral movement of the shoe.

The operation of the friction shoe assembly of the present invention within the laterally wider bolster friction shoe pocket 46 will now be described. It should be understood that gibs 80,82, illustrated in FIG. 5 are actually spaced in a generally wider location when compared to prior art bolsters so that friction shoe assembly 90 of the present invention has a chance to laterally travel within friction shoe pocket 46, which has also been correspondingly widened. In addition to the widening of the gibs and the friction shoe pockets, the friction shoe assembly 90 has been provided with a means to promote or initiate the lateral sliding, otherwise, it should be realized that the coefficient of friction between the friction shoe pocket 46 and the friction shoe assembly 90 is to large for lateral sliding movement to begin, even if provided the room to do so. The means for sliding is generally shown in FIG. 3 as being disposed between bolster friction shoe pocket floor 50 and biasing spring 120.

Referring again to FIG. 5, a detailed description of the present invention will now be provided. The laterally wider friction shoe pocket 46 of the present invention is shown extending inwardly into lateral side surface 48 of bolster end 38 and includes a horizontally disposed floor 50, which has an outboard side 55 which faces vertical columns 30,32 of sideframe 20 when inserted through bolster opening 24; it also has inboard side 57. Floor 50 is defined by three areas, front portion 51, rear portion 53, and central portion 52, with front and rear portions 51 and 53 being identical in both longitudinal extent or length and lateral extent or width, while the central portion 52 is seen to be both longitudinally and laterally larger than portions 51,53. Pocket 46 is further defined by a vertically extending back wall 60 interposed between two sloped friction walls 58 and 54, with back wall 60 extending further into sidewall 48 than either of the sloped friction walls 58,54. Each friction wall 58,54 extends generally downwardly and inwardly at an acute angle from upper surface 39 of bolster 35 to inboard side 57 on floor 50, while friction wall surfaces 59,55 frictionally engage with a correspondingly shaped surface on the friction shoe 91, which is seen as surfaces 106,108 in FIG. 4. Friction shoe pocket 46 is also defined by end walls 64 and 66 that have respective end wall surfaces 65 and 67. Projecting longitudinally outward from each of the respective end wall surfaces 65,67 at the outboard side 55 of floor 50, are posts 81,83. Each post 81,83 vertically extends from floor 50 upwardly to approximately bolster top wall 39, the very top tip of each post being chamferred for easier friction shoe installation. Posts 81 and 83 prevent friction shoe 91 from twisting within pocket 46 once loading forces operate on the assembly. As previously mentioned, the longitudinally spaced set of vertical gibs 80,82, project outwardly from each of the bolster side walls 48, each individual gib located on opposite ends of friction shoe pocket 46 for maintaining the position of a respective sideframe column therebetween.

Figure 4:
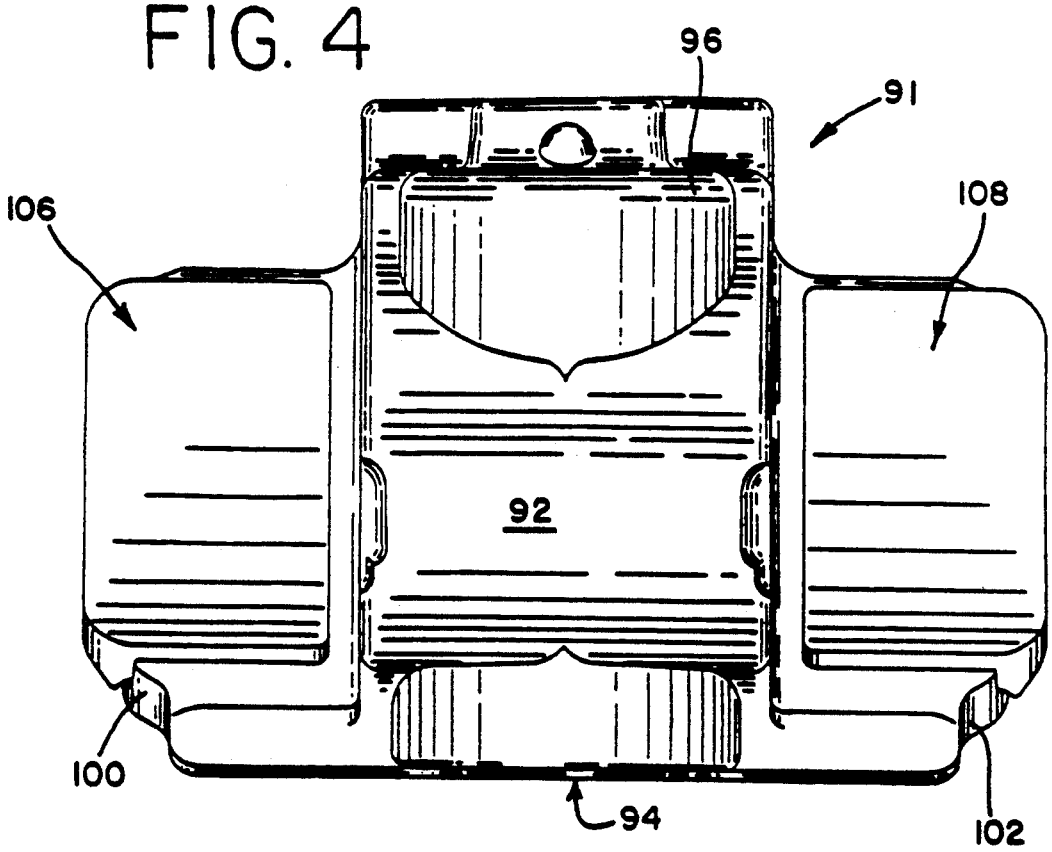
FIG. 4 is front view of the type of friction shoe used with the present invention.

As seen from FIGS. 3-5, besides providing a laterally wider friction shoe pocket 46 for allowing lateral movement, the present invention also provides a means to actually promote the sliding of the friction shoe assembly in the wider pocket. It is important to understand that the downward forces acting on the friction shoe create very high static friction forces between the shoe and the pocket floor, thereby retarding any lateral sliding of the friction shoe; those forces can only be overcome with the means for sliding. The means for promoting lateral sliding is a single system which is actually comprised of two different and separated parts. As illustrated in FIGS. 3 and 5, one part is generally the spring sled 140, which is attached to the friction shoe assembly 90 by post 150, while the other part consists of pad 70, attached to the wider friction shoe pocket 46. Pad 70 is a low coefficient of friction pad 70, such as an elastomeric material, and it is countersunk into floor 50. The spring sled preferably also has a pad attached to it too, as seen in FIG. 3, made from the same low coefficient of friction material as the pad 70 which is attached to floor 50. Floor 50 is shown with center portion 53 having a machined recess (impliedly shown) which is complementary to the shape of pad 70 in order to anchored the pad level with the surface of floor 50- Pad 70 is anchored within the recess by using flat head bolts(-not shown), which have the heads recessed into the pad. It is preferable to not to merely attach pad 70 to the top of floor 50 unless some type of surface preparation, such as a special foundry practice to assure flatness or even machining is first performed to floor 50 where the pad will fit. Otherwise, untoward casting imperfections could leave the pad unlevel or even unstable in either or both directions of the pocket. Here, only the central portion 53 of floor 50 was machined with an unseen recess, since the friction shoe assembly 90 will only have limited travel within the wider friction shoe pocket 46. Pad 70 is shown with a rectangular shape although its shape, and the shape of base plate 146 on sled 140, for that matter, are not important factors influencing the promotion of sliding. What is critical is the length of pad 70; it has to be longitudinally long enough to allow spring sled 140 enough room to always make contact with the pad once the friction shoe assembly laterally moves. Moreover, the shape of sled base plate 146 is not important either, as long as it will not interfere with lateral movement. As mentioned, pad 70 is made from a low coefficient of friction material commonly used in friction shoe applications, and preferably this material is the elastomeric product sold by the Polymer Corporation of Reading Pennsylvania under the trademark "Nylatron NSM®".

Pad 70 is shown here having a length approximate to the width 66 of pocket 46, and a width that substantially covers the width of floor 50, from inboard side 57 to outboard side 55 so that when base plate 146 moves, it will not bind against any part of the cast steel floor 50. For example, if a long, rectangular pad, in the form of a strip, were anchored longitudinally within pocket 46 at its lateral center point, the sled could possibly get stuck on a metal burr or spal once that strip wore down. If this happened, the operation of friction shoe assembly and the means for sliding, would be no different than if no pad 70 was used within pocket 46; in that case, assembly 90 would not slide. It was discovered that merely providing one part of the means for sliding without the other, will not create a low enough coefficient of friction to promote the initiation of lateral sliding. Furthermore, minimum surface preparation is required for each part of the two-part means or else sliding will not begin. For example, if floor 50 is supplied with pad 70, at minimum, the spring sled base plate bottom surface 147 (only seen in FIG. 4A) has to be a machined-prepared surface, or else the coefficient of friction under load, will not be low enough to initiate sliding. Alternatively, if the entire floor 50 was machined smooth, sled 140 would require a low coefficient of friction pad to be attached to bottom surface 147, in order create the same coefficient of friction as above so that sliding can be initiated. It necessarily follows that if spring sled bottom surface 147 and floor 50 were only machined surfaces, the friction shoe assembly 90 would not be able to slide since the coefficient of friction between the two metal surfaces would be too high. Briefly stated, at least one machined or specially cast surface, and one elastomerically padded surface is required in order to initiate sliding. It is actually preferable to anchor a low coefficient pad on both floor 50, and spring sled bottom surface 147, as seen in FIGS. 3 and 5, where bottom surface 147 of sled 140 has a low coefficient pad 71 anchored on it. By using low coefficient of friction material on each of the frictionally engaged surfaces, smaller lateral acceleration forces will more readily initiate lateral sliding, thus isolating even smaller lateral inputs from the car body.

Figure 4A:
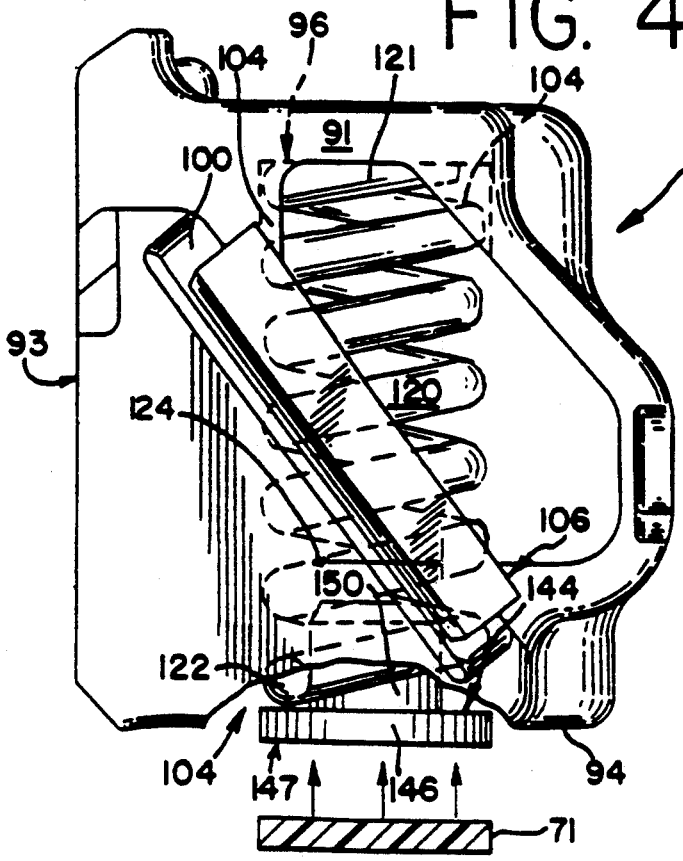
FIG. 4A is a partially cut-away side view of the friction shoe of FIG. 4 showing part of the means for initiating lateral movement.

Referring now to FIGS. 4 and 4*a*, a friction shoe assembly 90 is shown and it is comprised of winged friction shoe 91 and biasing spring 120. Friction shoe 91 is comprised of a cast metal central base portion 92, which includes a generally planar, generally vertical front face 93, and roof 96. Connected to base portion 92, on each side, are winged portions which have sloped downwardly sloped friction walls 100 and 102. Each wall 100,102 has a respective surfaces 106,108, which is complementary to the angled friction wear surfaces 59,55, on bolster pocket 46. Cylindrically shaped helical biasing spring 120 has a top end 121 and a bottom end 122, and is received within an internal cylindrical shaft 104 in the central base portion 92 of friction shoe 91. Spring top end 121 is inserted to contact roof 96 of friction shoe 90, while spring bottom end 122 extends beyond friction shoe bottom surface 94 such that bottom spring end 122 rests in contact with top base plate surface 144 of spring sled 140. As with any coiled spring, there is an opening extending the length of the spring which is defined by the windings of the spring. As seen from the illustration, biasing spring 120 has an opening extending between the top and bottom spring ends 121,122 such that spring sled post 150 can be insertably received within the opening, thereby joining spring sled 140 to friction shoe assembly 90. Post 150 is centered on top surface 144 of spring sled base plate 146 and the chamferred edge around the top of post 150 allows the post to be more easily inserted into the spring opening. Once biasing spring 120 is pushed down over post 150 and rests on top surface 144, the connected spring and sled combination are then inserted into friction shoe shaft 104. Spring sled 140 is preferably constructed by fabricating the necessary elements 150 and 146 and then welding those elements together, although it could be forged, or even made from composite materials such a ceramics. It is preferable to make the sled with a circular shape and of a diameter which will match the outside diameter of biasing spring 120 so that the spring does not overhang base plate 146 while resting on sled 140, although other shapes can be used. Biasing spring post 150 is of a diameter slightly smaller than inside diameter of the spring opening, which is inherently the inside diameter of spring 120, so that a very close-toleranced articulation exits between spring 120 and spring sled 140. The lack of free slack between these members prevents possible binding problems which could result.

As railway truck 10 travels down a railway track with the freight car weight supported thereon, bolster 35 is subjected to oscillations not only in the vertical and lateral directions, but also in a combination of both directions. As previously mentioned, the oscillations in the vertical direction are typically dampened by the vertical friction walls 93 of each friction shoe 91, rubbing against a corresponding side frame column friction plate 30 or 32. Sloped surfaces 100 and 102 on friction shoe 90 frictionally engage the complementary sloped surfaces 59, 55 on bolster to prevent the friction shoe from tipping inside pocket 46 when operating.

The present invention dissipates lateral forces by allowing the entire friction shoe assembly 90 to slide within a laterally wider friction shoe pocket 46. More specifically, since friction shoe pocket 46 is considered to be substantially wider than prior art friction shoe pockets, the entire assembly 90, including the spring sled 140, can laterally move or "float" in unison with each other but only if the second half of the sliding means is also used. By this it is meant that if only pad 70 were provided in floor 50, friction shoe assembly 90 would not slide until spring sled 140 was attached to biasing spring 120 because the post 150 provides structural support to the spring to prevent spring buckling under load, and it ensures that bottom end 122 will not gouge into pad 70 and possibly becoming stuck. Even when the spring only gouges into pad 70 without getting stuck, the bending stiffness of biasing spring 120 would temporarily resist the lateral forces working against the spring at that moment. When spring 120 and spring sled 140 begin moving in unison, the sled bottom surface 147 offers too large a surface area for the sled to gouge or get stuck on pad 70 so there is no other form of resistance offered to prevent lateral movement. Lateral movement of friction shoe assembly 90 merely becomes a matter of overcoming the smaller static friction forces which exist between friction shoe pocket floor pad 70 and spring sled bottom surface 147 and between the friction surfaces 106, 108 and 53 and 55 respectively. However, the static friction forces between surfaces 106,108 and 59,55 are relatively small because surfaces 106,108 typically are also covered with elastomeric pads having the same coefficient of friction material as pad 70. Furthermore, it was mentioned earlier that it is preferable to attach a low coefficient of friction pad 71 to the bottom surface 147 of spring sled 140, thereby reducing the static friction forces even further.

Upon movement of spring sled 140 on pad 70, the entire friction shoe assembly 90 is allowed to slide within pockets 46 in either lateral direction, preferably about one half of the diameter of biasing spring 120 before bolster gibs 80,82 prevent further lateral travel. It should be understood that the lateral travel distance which was added between gibs 80,82, also has to be added to each of the friction shoe pockets. The longitudinal length of each of the sloped friction surfaces 58,54, as well as longitudinal length 77 of back wall 60, has to be increased by the lateral distance added between the gibs. Specifically, since the shoe 91 can move in either lateral direction, the longitudinal length which has to be added to each of the individual sloped friction walls 58, and 54, is exactly one half the total distance the friction shoe assembly will be allowed to move. The back wall 60 will have to be lengthened by the full travel distance in order to provide the friction shoe 91 the capability to move in either direction. It has also been found that friction shoe assembly 90 should only be allowed to laterally travel in either direction, a distance of about one half the control spring diameter, otherwise the shoe could become cocked and jammed within a substantially wider friction shoe pocket.

By providing a bolster with a laterally wider friction shoe pocket, as well as providing a low coefficient of friction means to initiate the lateral sliding and floating of the entire friction shoe assembly 90 within the wider pocket, substantial lateral movement is now possible, thereby providing laterally decoupling the car body from the truck assembly for improved and safer railcar operations. The foregoing description has been provided to clearly define and completely describe the present invention. Various modifications may be made without departing from the scope and spirit of the invention, which is described in the following claims.

What is claimed is:

1. A railway car truck assembly, the combination comprising:

a first longitudinally extending truck sideframe and a second longitudinally extending truck sideframe, said first and second sideframes aligned and laterally spaced from each other, each of said sideframes having a transversely disposed opening, said openings in transverse alignment with each other for receiving a transversely extending bolster therebetween, said bolster having a pair of distal ends, each of said distal ends upwardly supported by respective spring sets attached to each of said sideframes;

a transversely extending truck bolster having a top wall, a bottom wall and two side walls, each of said top, bottom, and side walls cooperating to define a first bolster distal end and a second bolster distal end, each of said distal ends having a pair of opposed and open friction shoe pockets, each of said friction shoe pockets extending inwardly from said top and side walls of said bolster, each of said pockets comprised of a horizontally disposed floor with a inboard and outboard side and laterally extending front, central, and rear portions, said central portion of a transverse and laterally greater extent than said front and rear portions, said front and rear portions of substantially equal transverse and lateral extents, said inboard side of said floor having a first sloped friction surface attached to said floor front portion, a second sloped friction surface attached to said floor rear portion, and a vertically extending back wall attached to said floor central portion, said vertical back wall of a lateral extent substantially equal to said lateral extent of said floor central portion, said first sloped friction surface and said second sloped friction surface of a lateral extent substantially equal to said lateral extent of said floor front and rear portions, each of said first and second friction surfaces sloping from said bolster top wall downwardly and generally inwardly towards said back wall;

a friction shoe assembly received within each of said friction shoe pockets, said friction shoe assembly comprised of friction shoe and a friction shoe biasing spring, said friction shoe including a central base portion interconnecting a pair of winged portions and having a vertically extending hollow shaft which terminates at a roof, said central portion and said winged portions having a common bottom surface, said biasing spring having a top end and a bottom end, wherein said top end is insertably received within said shaft and contacts said roof and said bottom end extends outward of said shaft and said base portion in resting contact upon said friction shoe pocket floor, thereby biasing said friction shoe winged portions upwardly off said pocket floor and into sliding frictional engagement with said sloped shoe pocket friction surfaces; and means for promoting lateral sliding of said friction shoe assembly within said friction shoe pocket during encounters of lateral acceleration wherein said means overcomes static friction forces between said friction shoe assembly and said friction shoe pocket wall surfaces before said biasing spring experiences buckling, thereby providing isolation of said railcar truck assembly from said car body.

2. The truck assembly of claim 1 wherein each of said bolster friction shoe pockets is of a substantially greater lateral extent than said friction shoe assembly contained within said pocket, thereby allowing said friction shoe to laterally travel within said friction shoe pocket.

3. The truck assembly of claim 2 wherein said means to promote sliding includes at least one pad of low coefficient of friction material disposed between said bottom surface of said friction shoe and said floor of said friction shoe pocket.

4. The truck assembly of claim 3 wherein said low coefficient material is anchored to said floor of said friction shoe pocket.

5. The truck assembly of claim 4 wherein said means to promote sliding further includes a spring sled disposed between said biasing spring bottom end and said pad of said friction shoe pocket floor, said sled including a top wall with a smooth top surface and bottom wall with a smooth bottom surface and at least one side wall with a smooth side surface for connecting said top and bottom walls, said top wall including a centered post projecting upwardly from said top surface, said post articulated with said bottom end of said biasing spring, said articulation causing said friction shoe and said sled to laterally slide simultaneously in unison after said friction shoe experiences lateral motion.

6. The truck assembly of claim 5 wherein means to promote sliding further includes a second pad of low coefficient material, said second pad anchored to said bottom surface of said spring sled bottom wall.

7. The truck assembly of claim 6 wherein said second pad of low coefficient material substantially covers said bottom surface of said spring sled bottom wall.

8. The truck assembly of claim 7 wherein said second low coefficient of friction pad is made from an elastomeric material.

9. The truck assembly of claim 4 wherein said bolster pocket floor contains a recess for receiving said first pad of low coefficient material such that said pad is planar with said pocket floor when anchored.

10. The truck assembly of claim 9 wherein said pad substantially covers said central portion of said pocket floor.

11. The truck assembly of claim 10 wherein said low coefficient of friction pad is made from an elastomeric material.

12. A friction shoe assembly for use in a railway truck assembly, said truck assembly including a pair of longitudinally extending railcar sideframes, each of said sideframes aligned and laterally spaced from each other, each of said sideframes including a transversely disposed opening, said openings in transverse alignment with each other for receiving a transversely extending bolster therebetween, said bolster having a pair of distal ends, each of said distal ends provided with a pair of opposed and laterally wider friction shoe pockets for retaining at least one friction shoe assembly, each of said pockets extending inwardly from said top and side walls of said bolster, each of said pockets including a horizontally disposed floor with laterally extending front, central, and rear portions, and an inboard side and an outboard side, said central portion of a transverse and laterally greater extent than said front and rear portions, and said front and rear portions of substantially equal transverse and lateral extents, said inboard side of said floor having a first sloped friction wall attached to said floor front portion, a second sloped friction wall attached to said floor rear portion, and a vertically extending back wall attached to said floor central portion, said vertical back wall of a lateral extent substantially equal to said lateral extent of said floor central portion, said first sloped friction wall and said second sloped friction wall of a lateral extent substantially equal to said lateral extent of said floor front and rear portions, each of said first and second friction walls sloping from said bolster top wall downwardly and generally inwardly towards said back wall, said friction shoe assembly comprising:

a friction shoe having a central base portion; and a friction shoe biasing spring having a top end and a bottom end, said central base portion interconnecting a pair of winged portions such that said base and winged portions define a friction shoe bottom surface, said base portion including a vertically extending hollow shaft which terminates at a roof, wherein said spring top end is inserted into said shaft for contact with said roof and said spring bottom end outwardly extending beyond said friction shoe bottom surface in resting contact upon said friction shoe pocket floor such that said friction shoe bottom surface is upwardly biased off said floor and wherein said friction shoe winged portions are upwardly biased into engagement with said corresponding sloped friction shoe pocket friction surfaces; and means connected to said friction shoe spring for promoting lateral sliding of said friction shoe assembly within said laterally wider bolster friction shoe pocket when said railcar encounters lateral acceleration, wherein said means overcomes static friction forces between said friction shoe assembly and said friction shoe pocket wall surfaces before said biasing spring experiences buckling, thereby providing isolation of said railcar truck assembly from said car body.

13. The friction shoe assembly of claim 12 wherein said means to promote lateral sliding includes a spring sled disposed between said bottom of said biasing spring and said friction shoe pocket floor, said sled including a top wall with a top surface, a bottom wall with a bottom surface, and at least one side wall with a side surface, said side wall connecting said top and bottom walls, said top wall including a centered post projecting upwardly from said top surface, said post articulated with said bottom end of said biasing spring.

14. The friction shoe assembly of claim 13 wherein said spring sled bottom wall surface includes an attached pad, said pad of a low coefficient of friction material.

15. The friction shoe assembly of claim 14 wherein said pad is made from a low coefficient of friction elastomeric material.

16. The friction shoe assembly of claim 12 wherein said bolster friction shoe pocket includes an elastomeric pad anchored to said floor.

17. The friction shoe assembly of claim 16 wherein said pad is made from a low coefficient of friction elastomeric material.

18. A railway car truck bolster which promotes displacement of a friction shoe assembly along a lateral axis of a bolster friction shoe pocket while said assembly is retained within said pocket, said bolster transversely extending between a pair of longitudinally spaced truck assembly sideframes, said bolster comprising:

an extended box like structure having a top wall, a bottom wall, a first side wall, sand a second sidewall, each of said first and second sidewall joining said top and bottom walls, said structure including distal ends at each lateral end of said structure;

a first pair of spaced gibs on said first sidewall and a second pair of spaced gibs on said second sidewall, said first and second pairs of gibs proximate to each of said distal ends and in a opposed relationship such that said sideframe is held in position between said first and second pair of gibs;

a friction shoe pocket located between each pair of spaced gibs, each of said friction shoe pockets extending inwardly from said top and respective said sidewall and defining a lateral distance which a friction shoe assembly can travel, wherein said spacing between each of said gib pairs defines a second lateral distance, said second lateral distance equal to said lateral distance which said friction shoe assembly can travel when inside said friction shoe pocket wherein said friction shoe assembly includes means for promoting lateral sliding of said friction shoe so that travel of said friction shoe assembly within said bolster friction shoe pocket decouples said truck assembly from said railcar at the bolster.

19. A friction shoe spring sled for use with a railcar winged friction shoe having a helically coiled control spring for biasing said friction shoe into sliding frictional engagement with a friction surface inside a substantially wider railcar bolster friction shoe pocket, which said bolster transverses a pair of truck sideframes that are in a spaced and parallel arrangement, said friction shoe and said bolster arranged such that said friction shoe control spring continuously exerts a constant upward force upon said bolster friction surface, said spring sled comprising:

a base plate, said base plate having a top surface, a bottom surface, and side edges;

a post, said post vertically disposed upon said top surface of said base plate and attached to the center of said base plate top surface, said post insertably engaged within said spring such that said spring tightly clinches said post and touches said top surface of said base plate;

wherein said friction shoe spring sled allows said friction shoe and friction shoe control spring to simultaneously slide in unison laterally within said bolster friction shoe pocket such that said friction shoe laterally decouples said railcar from said sideframes when lateral forces are imparted to said railcar.

* * * * *